United States Patent [19]

Murata et al.

[11] 4,075,129

[45] Feb. 21, 1978

[54] DETERGENT COMPOSITION

[75] Inventors: Moriyasu Murata, Chiba; Makoto Yamanaka, Koganei; Takashi Fujino, Yokohama, all of Japan

[73] Assignee: Kao Soap Co., Ltd., Tokyo, Japan

[21] Appl. No.: 663,912

[22] Filed: Mar. 4, 1976

[30] Foreign Application Priority Data

Mar. 20, 1975 Japan ..... 50-33646

[51] Int. Cl.[2] ..... C11D 1/14; C11D 3/08

[52] U.S. Cl. ..... 252/527; 252/153; 252/532; 252/534; 252/546; 252/551; 252/553

[58] Field of Search ..... 252/531, 532, 550, 551, 252/DIG. 13, DIG. 14, 527, 546

[56] References Cited

U.S. PATENT DOCUMENTS

| | | | |
|---|---|---|---|
| 2,766,212 | 10/1956 | Grifo | 252/551 X |
| 3,391,750 | 7/1968 | Zika | 175/71 |
| 3,468,805 | 9/1969 | Grifo et al. | 252/551 X |
| 3,480,556 | 11/1969 | De Witt et al. | 252/551 X |
| 3,513,099 | 5/1970 | Hans et al. | 252/532 X |
| 3,786,003 | 1/1974 | Hunter | 252/551 |

FOREIGN PATENT DOCUMENTS

| | | |
|---|---|---|
| 1,436,283 | 3/1966 | France. |
| 987,417 | 3/1965 | United Kingdom. |
| 1,229,134 | 4/1971 | United Kingdom. |
| 1,091,517 | 11/1967 | United Kingdom. |

OTHER PUBLICATIONS

Schonfeldt, "Surface Active Ethylene Oxide Adducts," Pergamon Press, 1969, N.Y. pp. 638–647.

*Primary Examiner*—P.E. Willis, Jr.

*Attorney, Agent, or Firm*—Blanchard, Flynn, Thiel, Boutell & Tanis

[57] ABSTRACT

A detergent composition comprising as all or a part of the active detergent component a mixture comprising (A) up to 70% by weight of unbranched-alkyl ether sulfate, or mixtures thereof, having the formula (I):

$$R_1—O—(CH_2CH_2O)_nSO_3M \quad (I)$$

wherein $R_1$ is unbranched alkyl ($CH_3(CH_2)_p$—) having a total number of from 6 to 15 carbon atoms and having a carbon atom number distribution such that the average carbon atom number is within the range of from 8 to 13, *n* is from 0.5 to 1.5 as an average number in the mixture, and M is alkali metal, alkaline earth metal, ammonium or alkanol amine, and (B) at least 30% by weight of a branched alkyl ether sulfate, or mixtures thereof, having the formula (II):

$$R_2—\underset{\underset{R_3}{|}}{CH}—CH_2—O—(CH_2CH_2O)_nSO_3M \quad (II)$$

wherein $R_2$ is an unbranched alkyl having 1 to 12 carbon atoms, $R_3$ is an unbranched alkyl having 1 to 4 carbon atoms, the group $$R_2—\underset{\underset{R_3}{|}}{CH}—CH_2—$$

having a carbon number distribution such that the average carbon atom number thereof is within the range of from 8 to 13, and *n* nd M are as defined above for formula (I).

6 Claims, No Drawings

DETERGENT COMPOSITION

BACKGROUND OF THE INVENTION

1. Field of the Invention

This invention relates to a detergent composition which possesses excellent resistance to hard water, in which the amount of sodium tripolyphosphate employed as a builder can be greatly reduced or sodium tripolyphosphate can be entirely omitted, and which possesses an excellent rinsing property after washing.

2. Description of the Prior Art

Although the demand for sodium tripolyphosphate as a builder component in detergents has been increasing, various limitations have been imposed on the use of this builder because of the wide-spread shortage of phosphate rock, its high price and the like. Further, it is known that phosphate components contained in discharged washing solutions cause eutrophication and pollution in rivers and lakes. Accordingly, in the detergent art, there have been serious problems of how to reduce the amount of sodium tripolyphosphate and how to utilize it more efficiently in detergents.

Various attempts have heretofore been made to solve these problems, and these known attempts are generally divided in two types; one type is directed to a method in which another builder is used as a substitute for sodium tripolyphosphate and the other type is directed to a method in which a surface active agent possessing excellent resistance to hard water is used as the effective detergent component. In the former method, however, there has not been discovered any practical builder that can be used instead of sodium tripolyphosphate and that will provide satisfactorily good results with respect to washing ability, cost and other economic factors, safety and the like. In connection with the latter method, the use of hard water-resistant polyoxyethylene alkyl ether sulfates (hereinafter referred to simply as "ether sulfates" or "ES"), which are salts of sulfuric acid esters of adducts of 3 to 5 moles of ethylene oxide to higher alcohols having 12 to 18 carbon atoms in the alkyl group, has been proposed and practiced. These ether sulfates, which have been effectively used for detergents, have a good resistance to hard water, but they have a foaming characteristic such that foaming increases with an increase of water hardness at low concentrations. This characteristic makes it difficult to remove foam during the rinsing step after washing. In fact, in the case of ether sulfate-containing detergents for clothing, tableware, hair, furniture or the like, foams do not disappear smoothly and sufficiently during the rinsing or finishing step. This defect in rinseability decreases the commercial value of detergent products. Accordingly, if this defect can be ameliorated, it will be possible to provide a phosphate-free or low phosphate detergent having a high commercial value and which can be easily used by consumers with saving of rinsing water.

SUMMARY OF THE INVENTION

We discovered, unexpectedly in view of the prior art, that if an ether sulfate of a special structure having a greatly reduced number of carbon atoms in the alkyl group, a high branching ratio and a greatly reduced number of moles of added ethylene oxide, which special ether sulfate has heretofore not been used in the detergent art, is incorporated as the main detergent component, there is obtained a detergent composition having a high resistance to hard water and a greatly improved rinsing property.

More specifically, in accordance with this invention, there is provided a detergent composition comprising as all or a part of the active surfactant component a mixture comprising (A) up to 70% by weight of an unbranched-alkyl ether sulfate, or mixtures thereof, having the formula (I):

$$R_1—O—(CH_2CH_2O)_nSO_3M \quad (I)$$

wherein $R_1$ is an unbranched alkyl ($CH_3(CH_2)_p$—) having a total number of from 6 to 15 carbon atoms and having a carbon atom number distribution such that the average carbon atom number is within the range of from 8 to 13, $n$ is from 0.5 to 1.5 as an average number in the mixture, and M is alkali metal, alkaline earth metal, ammonium or alkanol amine, and (B) at least 30% by weight of a branched-alkyl ether sulfate having the formula (II):

$$R_2—\underset{\underset{R_3}{|}}{CH}—CH_2—O—(CH_2CH_2O)_nSO_3M \quad (II)$$

wherein $R_2$ is an unbranched alkyl having 1 to 12 carbon atoms, $R_3$ is an unbranched alkyl having 1 to 4 carbon atoms, with the proviso that the group $$R_2—\underset{\underset{R_3}{|}}{CH}—CH_2—$$

has a carbon atom number distribution such that the average carbon atom number is within the range of from 8 to 13, and $n$ and M are as defined above for formula (I).

The amount of ether sulfate of formula (I) is from zero to 70% by weight, preferably from 30 to 65 percent by weight, based on the sum of ether sulfate of formula (I) plus ether sulfate of formula (II). The balance of the total ether sulfate surfactant component is ether sulfate of formula (II).

The detergent composition of the present invention has an excellent resistance to hard water, as good as that of conventional ether sulfate-containing detergents, and it does not cause precipitation at all in water having a very high hardness. Accordingly, the amount of sodium tripolyphosphate incorporated in the detergent composition of the present invention can be greatly reduced as compared with conventional detergents comprising as an active surfactant component a linear alkyl benzenesulfonate (hereinafter referred to as "LAS") or an olefin sulfonate (hereinafter referred to as "OS"). Indeed, sodium tripolyphosphate can be completely omitted. Further, even a phosphate-free or a low phosphate detergent composition of the present invention shows a very high washing power. Still further, the desirable characteristics of known ether sulfate detergents are completely retained in the detergent composition of the present invention, but the fatal defect of those conventional ether sulfate detergents, namely, their poor rinsing property, is substantially overcome in the detergent of the present invention. The detergent composition of the invention provides good foam breaking during the rinsing step.

The foregoing characteristics of the detergent of the present invention can be attained by the use, as the active detergent component, of an ether sulfate composition having the above-mentioned special structure. More specifically, the starting alcohol mixture, used to make the special ether sulfate component, has a short alkyl group having 6 to 15 carbon atoms, in which the average carbon number of the alcohol mixture is within the range of from 8 to 13, and at least 30% of the total alcohols should have a branched chain on the carbon atom at the 2-position (in the instant specification, the term "branching ratio" means the proportion of such branched alcohols in the total alcohols). Such a starting alcohol mixture is known and prepared, for example, according to a process disclosed in the following literatures: G. B. Borsari, F. Buosi and E. P. Fuochi, La Rivista Italiana Delle Sostanze Grasse, Vol. L1 (Giugno 1974), page 193–207 and 253–265. The special ether sulfate composition that is used in the present invention can be prepared by adding ethylene oxide to such an alcohol mixture according to a conventional method and then sulfating and neutralizing the adduct. In the present invention, it is critical that the number of moles of ethylene oxide added should be small, namely, within a range of from 0.5 to 1.5 on the average. In the detergent of the present invention, a delicate balance must be established among the carbon atom number distribution, the branching ratio in the alkyl group of the ether sulfate and the number of moles of ethylene oxide added to the ether sulfate. If the carbon number of the alkyl group is too large or the branching ratio is lower than 30%, or if the number of moles of ethylene oxide added exceeds 1.5, sufficient foam breaking cannot be attained in the resulting detergent during the rinsing step. When the number of moles of ethylene oxide added is within the range of from 0.5 to 1.5 as specified in the present invention, a smaller number of carbon atoms in the alkyl group or a higher branching ratio gives a better rinsing and higher resistance to hard water.

In the detergent composition of the present invention, the total amount of the sum of the ether sulfates of the above general formulae (I) and (II) is from 0.5 to 60% by weight. More specifically, from 0.5 to 14% by weight of ether sulfates of formulae (I) and (II) can be used to replace a corresponding amount of anionic surfactant in conventional anionic powdery detergent compositions so that the content of sodium tripolyphosphate thereof can be decreased. When the detergent does not contain sodium tripolyphosphate at all, the content of the ether sulfates (I) and (II) is within the range of 2.5 to 25% by weight. In the case of a liquid heavy duty detergent, the content of the ether sulfates (I) and (II) is within the range of 2.5 to 60% by weight.

The detergent composition of the present invention comprises ether sulfates of formulae (I) and (II) as critical detergent component. It may further contain various conventional water-soluble anionic surfactants, except that it should not contain other ether sulfates, i.e., ether sulfates having formulas different from formulae (I) and (II), such as alkyl ether sulfates and alkylphenol ether sulfates.

The detergent composition can contain water-soluble amphoteric surfactants and water-soluble nonionic surfactants as additional detergent components. As the water-soluble anionic surfactants that can be used in combination with the ether sulfates of formulae (I) and (II), there can be mentioned the anionic surfactants conventionally used for clothes washing, dishwashing and hair shampooing, for example, alkyl benzene sulfonates, alkyl sulfates, α-olefin sulfonates, alkane sulfonates, alkyl ether carboxylates and fatty acid salts having 11 to 18 carbon atoms in the alkyl group. As the amphoteric surfactants, there can be used the conventional amphoteric surfactants, for example, alkyl betaines, alkyl alanines and alkyl sulfobetaines having 10 to 20 carbon atoms in the alkyl group. Still further, there can be used, conventional nonionic surfactants such as polyoxyethylene alkyl ethers, polyoxyethylene alkylphenol ethers, polyoxyethylene fatty acid esters and polyoxyethylene sorbitan fatty acid esters having an HLB value of from 8 to 18. When surface active agents of different kinds such as those mentioned above are used in combination with the ether sulfates (I) and (II), in the detergent composition of the present invention, it is critical that the total content of the ether sulfates of formulae (I) and (II) should be at least 2.5% by weight, preferably more than 10% by weight, of the total active surfactant components.

The detergent composition of the present invention can further contain from zero to 40% by weight of conventional phosphate builder salts, such as sodium tripolyphosphate, sodium pyrophosphate or sodium metaphosphate, from zero to 20% by weight of conventional heavy metal-sequestering agents such as nitrilotriacetates, ethylene diamine tetraacetates, citrates, polyacrylates or water-soluble salts of a maleic anhydride-vinyl acetate copolymer, and from 5 to 40% by weight of conventional alkaline and neutral builder salts such as silicates, carbonates, sulfates and borates. When the detergent of the present invention is a liquid detergent, it may further comprise from one to 20% by weight of conventional solubilizing agents such as ethanol, methanol, urea, a p-toluenesulfonate, a xylenesulfonate or a naphthalenesulfonate. Furthermore, an enzyme, a bleaching agent of the enzyme type, a fluorescent dye, a bluing agent, a perfume or other conventional detergent additives can be incorporated in the detergent of the present invention according to need in the range up to 3% by weight.

The present invention will now be further described by reference to the following illustrative Examples, in which all of the percent values are by weight.

EXAMPLE 1

Powder detergents containing various surfactants as the active washing component and having the composition indicated below were subjected to washing and rinsing tests as described below.

(1) Composition of Detergent:

| | |
|---|---|
| Surface active agent (listed in Table 1) | 20% |
| Soap | 1.0% |
| Sodium tripolyphosphate | 0 or 20% |
| Sodium silicate | 10% |
| Sodium carbonate | 5% |
| Polyethylene glycol (average molecular weight of 6,000) | 0.5% |
| Carboxymethyl cellulose | 0.5% |
| Water | 10% |
| Glauber's salt | balance |
| Total | 100.0% |

(2) Washing Test:

Twelve sheets of artificially soiled cloths having a size of 10 cm × 10 cm were placed in 1 l of an aqueous solution of the detergent, and unsoiled cloths of the same size as mentioned above were further put into the solution so that the bath ratio was 1/60. Washing was conducted under the following conditions by using a Terg-O-Meter rotated at 100 rpm.

The washing conditions and the oil composition used for soiling the clothes are as follows:

| | |
|---|---|
| Washing Conditions | |
| | Detergent concentration: 0.1% |
| | Hardness of water: 8° DH |
| | Water temperature: 20° C |
| | Washing time: 10 minutes |
| | Rinsing: 5 minutes by using service water |
| Oil Composition of Soil | |
| | Cotton seed oil: 60% |
| | Cholesterol: 10% |
| | Oleic acid: 10% |
| | Palmitic acid: 10% |
| | Liquid and solid paraffins: 10% |

The reflectances of the unsoiled cloth and the soiled cloth were measured by an automatic recording colorimeter (manufactured by Shimazu Seisakusho), and the washing power (%) was calculated according to the following equation:

$$\text{Washing power (\%)} = (A - B)/(C - B) \times 100$$

wherein A denotes the reflectance of the soiled cloth after washing, B denotes the reflectance of the soiled cloth before washing, and C denotes the reflectance of the unsoiled cloth before washing. Each value shown in Table 1 is an average value obtained as a result of the measurement of 12 cloths.

(3) Rinsing Test:

30 l of service water was placed in an agitator type washing machine (manufactured by Toshiba Co.), and 40 g of the detergent was added thereto. The mixture was agitated to dissolve the detergent in water. A soiled cloth sample was prepared by uniformly coating 3 g of the above-mentioned soiling oil composition on 1 Kg of a cotton underwear. The soiled cloth was immersed in the above washing solution and washed for 10 minutes under vigorous back and forth agitation. Then, the washed sample clothes was dewatered for 1 minute by means of a spin-type water extractor. The washing solution was discharged from the washing machine and 30 l of service water maintained at 20° C was poured in, as a first rinsing liquid. The dewatered sample was immersed in this rinsing water and it was rinsed under vigorous, back and forth agitation for 3 minutes. Then, the foam state in the washing machine tank was evaluated according to the following criteria and the foam state after the first rinsing was determined. The above rinsing procedure was repeated again, and the foam state after second rinsing was similarly determined.

Scale for Evaluation of Foaming

| Index | Foam State |
|---|---|
| 5 | abundant heaps of foam that reach the control panel of the washing machine |
| 4 | less abundant heaps of foam that do not reach the control panel of the washing machine |
| 3 | foam covers the entire liquid surface in the tank in a thickness of 3 to 5 cm |
| 2 | foam covers the entire liquid surface in the tank in a thickness of 1 to 2 cm |
| 1 | foam covers about one-half of the liquid surface in the tank but the other half of the liquid surface is not covered with foam |
| 0 | no foam is observed |

From practical experience, rinsing is insufficient when the foaming index is 2 or more, and even when the foaming index is 1, the rinsing is still insufficient and additional rinsing is generally conducted.

The results of the above washing and rinsing tests are shown in Table 1. In Table 1 the detergent of the present invention is No. 7.

Table 1

| Detergent No. | Surface Active Agent | Amount of STPP (wt. %) | Washing Power (%) | Foam Index at Rinsing first rinsing | Foam Index at Rinsing second rinsing |
|---|---|---|---|---|---|
| 1 (control) | sodium linear dodecyl benzene-sulfonate | 20 | 25.0 | 1 | 0 |
| 2 (control) | " | 0 | 14.9 | 1 | 0 |
| 3 (control) | sodium α-olefin sulfonate ($\bar{R}$ = 12) | 0 | 21.0 | 1 | 0 |
| 4 (control) | sodium vinylidene type olefin sulfonate ($\bar{R}$ = 18) | 0 | 14.0 | 1 | 0 |
| 5 (control) | sodium alkane sulfonate ($\bar{R}$ = 15) | 0 | 13.5 | 2 | 1 - 0 |
| 6 (control) | sodium alkyl ether sulfate ($\bar{R}$ = 14.5, branching ratio = 36%, $\bar{n}$ = 3.0) | 0 | 35.5 | 2 | 2 |
| 7 (invention) | sodium alkyl ether sulfate ($\bar{R}$ = 12.4, branching ration = 36%, $\bar{n}$ = 1.0) | 0 | 35.3 | 1 | 0 |
| 8 (control) | sodium alkyl ether sulfate ($\bar{R}$ = 12.4, branching ratio = 36%, $\bar{n}$ = 0.3) | 0 | 23.2 | 1 | 0 |
| 9 (control) | sodium alkyl sulfate ($\bar{R}$ = 12.4, branching ratio = 36%) | 0 | 20.0 | 0 | 0 |

Notes
STPP: sodium tripolyphosphate,
$\bar{R}$: average carbon atom number of akyl group,
$\bar{n}$: average number of moles of added ethylene oxide From the results shown in Table 1, the following observations can be made:

In the case of the most popular surfactant, namely LAS, not only a good rinsing property but also a high washing power can be obtained even in the case of water having a hardness of 8° DH when 20% of sodium tripolyphosphate is incorporated, but the washing power is drastically lowered when sodium tripolyphosphate is not incorporated (compare detergents Nos. 1 and 2). Similar poor washing power results are obtained when other anionic surfactants, free of STPP, (detergents Nos. 3 to 5) are employed. In contrast, the detergent of the present invention (detergent No. 7) has a very high resistance to hard water, and it shows a very high washing power even in hard water without incorporation of sodium tripolyphosphate. Simultaneously, the detergent of the present invention has a very good rinsing property. A conventional ether sulfate (detergent No. 6) heretofore used as a detergent component resistant to hard water has a good washing power in hard water, but its rinsing property is extremely bad. Detergent Nos. 8 and 9 show poor washing power.

EXAMPLE 2

Powdery detergents for clothing having a composition as indicated below and containing various alkyl ether sulfates as listed in Table 2 were tested as to their rinseability after washing. The rinsing test was conducted in the same manner as described in Example 1. Detergent No. 1 contained 20% sodium linear dodecyl benzene sulfonate and zero sodium alkyl ether sulfate. The other detergents had the following composition.

Composition of Detergent:

| | |
|---|---|
| Sodium linear dodecyl benzenesulfonate | 10.0% |
| Sodium alkyl ether sulfate | 10.0% |
| Soap | 1.0% |
| Sodium tripolyphosphate | 15.0% |
| Sodium silicate | 10.0% |
| Sodium carbonate | 5.0% |
| Polyethylene glycol (average molecular weight = 6,000) | 0.5% |
| Carboxymethyl cellulose | 0.5% |
| Water | 10.0% |
| Glauber's salt | balance |
| Total | 100.0% |

The results of the rinsing tests are shown in Table 2.

Table 2

| Detergent No. | Ether sulfate (ES) average carbon number in alkyl group | branching ratio (%) | average mole number of added EO | Foaming Index first rinsing | second rinsing |
|---|---|---|---|---|---|
| 1 | (sodium dodecyl benzenesulfonate) | | | 1 | 0 |
| 2 | 8.0 | 0 | 5.0 | 2 | 2 |
| 3* | 8.0 | 35 | 0.5 | 1 | 0 |
| 4 | 10.0 | 25 | 3.0 | 2 | 1 |
| 5* | 10.0 | 35 | 1.0 | 1 | 0 |
| 6 | 12.0 | 0 | 1.0 | 2 | 2 |
| 7 | 12.6 | 23 | 1.0 | 2 | 2 |
| 8* | 12.4 | 36 | 1.0 | 1 | 0 |
| 9* | 12.3 | 51 | 1.0 | 0 | 0 |
| 10* | 12.5 | 72 | 1.0 | 0 | 0 |
| 11* | 12.4 | 36 | 0.5 | 0 | 0 |
| 12* | 12.4 | 36 | 1.5 | 1 | 0 |
| 13 | 12.4 | 36 | 3.0 | 2 | 1 |
| 14 | 12.4 | 36 | 5.0 | 2 | 2 |
| 15 | 12.4 | 36 | 10.0 | 2 | 2 |
| 16* | 13.0 | 56 | 1.0 | 2 | 0 |
| 17 | 14.5 | 36 | 1.0 | 2 | 2 |
| 18 | 17.0 | 72 | 1.0 | 2 | 2 |
| 19 | 14.0 | 35 | 0.5 | 2 | 2 |

Table 2-continued

| Detergent No. | Ether sulfate (ES) average carbon number in alkyl group | branching ratio (%) | average mole number of added EO | Foaming Index first rinsing | second rinsing |
|---|---|---|---|---|---|
| 20 | 16.0 | 0 | 0.5 | 2 | 2 |

Notes:
1. The detergents marked with an asterisk (Nos. 3, 5, 8–12 and 16) are those according to the present invention. The other detergents are controls.

As is seen from the foregoing results, in the case of the detergent of the present invention, foams are substantially broken during the first rinsing and foams disappear completely during the second rinsing, and the detergents of the present invention have a very excellent rinsing property. However, in the case of detergents having a low branching ratio or a large average carbon number in the alkyl group or a large mole number of added ethylene oxide or in the case of detergents comprising a conventional ether sulfate, considerable foams are left even after the second rinsing, and they are inferior in the rinsing property.

EXAMPLE 3

The following two ether sulfates (ES-A and ES-B) were mixed to form an ether sulfate mixture (ES-mix). In the composition of the detergent shown in Example 2, ES-mix was used as the alkyl ether sulfate, and the resulting detergent was tested on the rinsing property in the same manner as in Example 1 and the rinsing property of the detergent was compared with that of the detergent (sample No. 8) according to the present invention. The results are shown in Table 3.

Table 3

| Detergent No. | Average Composition of Starting ES and ES-mix | ES-A | ES-B | ES-mix | Foaming Index first rinsing | second rinsing |
|---|---|---|---|---|---|---|
| 21 | average carbon number in alkyl group | 7.3 | 17.5 | 12.4 | 2 | 2 |
| | branching ratio (%) in alkyl group | 36 | 36 | 36 | | |
| | average mole number of added EO | 1.0 | 1.0 | 1.0 | | |
| | mixing ratio (%) | 50 | 50 | — | | |
| 22 | average carbon number in alkyl group | 12.4 | 12.4 | 12.4 | 2 | 2 |
| | branching ratio (%) in alkyl group | 36 | 36 | 36 | | |
| | average mole number of added EO | 0 | 5.0 | 1.0 | | |
| | mixing ratio (%) | 80 | 20 | — | | |
| 8 | average carbon number in alkyl group | 12.4 | | | 1 | 0 |
| | branching ratio (%) in alkyl group | 36 | | | | |
| | average mole number of added EO | 1.0 | | | | |

As is apparent from the above results, even when ether sulfates other than ES specified in the present invention are used and mixed to form an ES mixture having an average composition included in the scope of the present invention and the thus-formed detergent is employed, the rinsing property is not improved at all.

EXAMPLE 4

The liquid detergent compositions indicated in Table 4 were prepared and tested as to their rinsing property in the same manner as described in Example 1. The results are shown in Table 4.

Table 4

| Ingredients (%) | Detergent No. 23* | 24 | 25* | 26 | 27* | 28 |
|---|---|---|---|---|---|---|
| triethanolamine salt of ES used in detergent No. 8 of Example 2 | 10 | — | 10 | — | 15 | — |
| triethanolamine salt of ES used in detergent No. 13 of Example 2 | 2 | 12 | — | — | — | 15 |
| triethanolamine salt of LAS used in detergent No. 1 of Example 2 | — | — | 5 | 5 | — | — |
| triethanolamine salt of secondary fatty alcohol ES ($\bar{R}$=14.5,n=3) | — | — | 3 | 13 | — | — |
| sodium olefin sulfonate ($\bar{R}$=16.2, α-olefin/internal olefin=20/80) | 5 | 5 | — | — | — | — |
| sodium alkane sulfonate (average molecular weight = 319) | 5 | 5 | — | — | — | — |
| sodium vinylidene type of olefin sulfonate ($\bar{R}$ = 16) | — | — | 5 | 5 | — | — |
| polyoxyethylene dodecyl ether $\bar{n}$ = 8) | — | — | — | — | 15 | 15 |
| potassium pyrophosphate | 5 | 5 | — | — | — | — |
| sodium metasilicate | 2 | 2 | — | — | — | — |
| triethanolamine | — | — | 5 | 5 | 5 | 5 |
| ethanol | — | — | 5 | 5 | 5 | 5 |
| p-toluenesulfonic acid | 10 | 10 | — | — | — | — |
| water | 61 | 61 | 67 | 67 | 60 | 60 |
| foaming index at first rinsing | 1 | 2 | 1 | 2 | 1 | 2 |
| foaming index at second rinsing | 0 | 2 | 0 | 2 | 0 | 2 |

Notes:
$\bar{R}$: average carbon atom number in alkyl group
$\bar{n}$: average mole number of added ethylene oxide Detergents of the present invention (marked with an asterisk, Nos. 23, 25 and 27) have excellent rinsing characteristics even when other anionic or non-ionic surfactants are used in combination.

EXAMPLE 5

Various detergent compositions for tableware, furniture or shampoo, which comprised the ingredients shown in Table 5, were prepared. 3 l of a 0.2% aqueous solution of the detergent was placed in a bowl, and it was sufficiently agitated with a sponge to cause foaming. The foamed solution was poured into a stainless steel sink. Then, water was continuously flowed at a constant rate until foams were completely removed from the discharge port of the sink. The rinsing property was determined based on the duration of the water-flow time. The results are shown in Table 5.

Table 5

| Ingredients (%) | Detergent No. 29* | 30 | 31 | 32* | 33 | 34 | 35* | 36 |
|---|---|---|---|---|---|---|---|---|
| LAS used in detergent No. 1 of Example 1 | 15 | 15 | 15 | 7 | 7 | | | |
| ES used in detergent No. 8 of Example 2 | 5 | | | 8 | | | 10 | |
| ES used in detergent No. 13 of Example 2 | | 5 | | | 8 | | | 10 |
| triethanolamine alkyl sulfate ($\bar{R}$=12.5, branching ratio=25% | | | | | | 20 | 10 | 10 |
| coconut fatty acid diethanolamide | | | 3 | 3 | 3 | 3 | 3 | 3 |
| sodium pyrophosphate | | | 10 | 10 | 10 | | | |
| glycerin | | | | | | 5 | 5 | 5 |
| propylene glycol | | | 5 | 5 | 5 | | | |
| potassium p-toluenesulfonate | | | 15 | 5 | 5 | | | |
| ethanol | 5 | 5 | 5 | 5 | 5 | | | |
| urea | 10 | 10 | | | | 5 | 5 | 5 |
| ammonium chloride | 0.5 | 0.5 | | | | 0.3 | 0.3 | 0.3 |
| water | 64.5 | 64.5 | 57 | 57 | 57 | 66.7 | 66.7 | 66.7 |
| Rinsing Property | ◎ | X | Δ | ◎ | X | Δ | ◎ | X |

Notes:
1. Detergents Nos. 29 and 30 are for tableware, detergent Nos. 31 to 33 are for furniture, and detergents Nos. 34 to 36 are for shampoo.
2. Detergents marked with an asterisk (Nos. 29, 32 and 35) are those according to the present invention.
3. The rinsing property was judged on the following scale:
◎: rinsing is easy
66 : rinsing is slightly difficult
X: rinsing is difficult.

The embodiments of the invention in which an exclusive property or privilege is claimed are defined as follows:

1. A detergent composition consisting essentially of from 0.5 to 60 percent by weight of ether sulfate surfactant consisting of (A) from 30 to 65 percent by weight of unbranched-alkyl ether sulfate having the formula $$R_1—O—(CH_2CH_2O)_nSO_3M$$

and (B) the balance is branched-alkyl ether sulfate having the formula $$R_2—\underset{\underset{R_3}{|}}{CH}—CH_2—O—(CH_2CH_2O)_nSO_3M \qquad (II)$$

wherein $R_1$ is unbranched alkyl having a carbon atom number range of from 6 to 15 and wherein the average number of carbon atoms in $R_1$ of (A) in the range of from 8 to 13, $R_2$ is unbranched alkyl having a carbon atom number range of from one to 12, $R_3$ is unbranched alkyl having a carbon atom number range of from one to 4, with the proviso that $$R_2—\underset{\underset{R_3}{|}}{CH}—CH_2—$$

has an average numer of carbon atoms in the range of from 8 to 13, $n$ is a number from 0.5 to 1.5 as an average for (A) and (B), and M is a water-solubilizing cation selected from the group consisting of alkali metals, alkaline earth metals and alkanol amines;

and the balance of said detergent composition is water-soluble, anionic surfactant with the proviso that said anionic surfactant is not an ether sulfate, or water-soluble, synthetic, nonionic surfactant, or water-soluble, synthetic, amphoteric surfactant, or water-soluble alkaline or neutral inorganic builder salt, or water-soluble organic heavy metal-sequestering agents, or solubilizing agents, or water, or mixtures thereof.

2. A composition as claimed in claim 1, containing from 2.5 to 25 percent by weight of said ether sulfate surfactant, said composition being free of sodium tripolyphosphate.

3. A composition as claimed in claim 1, being a liquid heavy duty detergent composition containing from 2.5 to 60 percent by weight of said ether sulfate surfactant.

4. A composition as claimed in claim 1 containing from 10 to 60 percent by weight of said ether sulfate surfactant.

5. A composition as claimed in claim 1 containing from zero to 40 percent by weight of water-soluble phosphate builder salts, from zero to 20 percent by weight of water-soluble organic heavy metal-sequestering agents selected from the group consisting of nitrilotriacetates, ethylenediamine tetraacetates, citrates, polyacrylates and water-soluble salts of maleic anhydride-vinyl acetate copolymer, and from 5 to 40 percent by weight of alkaline and neutral water-soluble builder salts selected from the group consisting of silicates, carbonates, sulfates and borates.

6. A composition as claimed in claim 3 containing from one to 20 percent by weight of a solubilizing agent selected from the group consisting of ethanol, methanol, urea, p-toluene sulfonate, xylene sulfonate and naphthalene sulfonate.

* * * * *